US007197779B2

(12) United States Patent
Shalikar

(10) Patent No.: US 7,197,779 B2
(45) Date of Patent: Apr. 3, 2007

(54) SIDE RAIL ASSEMBLY FOR BEDS

(75) Inventor: Mohtasham Shalikar, Moreno Valley, CA (US)

(73) Assignee: Medical Equipment & Supplies Discount Center Inc., Two, Riverside, CA (US)

( * ) Notice: Subject to any disclaimer, the term of this patent is extended or adjusted under 35 U.S.C. 154(b) by 0 days.

(21) Appl. No.: 11/272,230

(22) Filed: Nov. 10, 2005

(65) Prior Publication Data

US 2006/0101578 A1 May 18, 2006

Related U.S. Application Data

(60) Provisional application No. 60/627,558, filed on Nov. 12, 2004.

(51) Int. Cl.
*A47C 21/08* (2006.01)

(52) U.S. Cl. ..... 5/426; 5/429; 5/425

(58) Field of Classification Search ..... 5/425–430, 5/662

See application file for complete search history.

(56) References Cited

U.S. PATENT DOCUMENTS 2,722,017 A * 11/1955 Burst et al. ..... 5/428
2,817,855 A * 12/1957 Pratt ..... 5/430
2,859,454 A * 11/1958 Beckwell ..... 5/426
2,904,799 A * 9/1959 Berlin ..... 5/426
2,929,078 A * 3/1960 Smith et al. ..... 5/428
2,991,487 A * 7/1961 Beckwell ..... 5/426
3,021,534 A * 2/1962 Hausted ..... 5/430
3,125,769 A * 3/1964 Black et al. ..... 5/430
3,179,957 A * 4/1965 Norton ..... 5/428
3,220,024 A * 11/1965 Nelson ..... 5/429
3,585,659 A * 6/1971 Burst et al. ..... 5/430
3,616,469 A * 11/1971 Injeski ..... 5/171
3,855,654 A * 12/1974 Pivacek ..... 5/429
3,971,083 A * 7/1976 Peterson ..... 5/430
4,103,376 A * 8/1978 Benoit et al. ..... 5/430
4,439,880 A * 4/1984 Koncelik et al. ..... 5/429
4,724,559 A * 2/1988 Bly et al. ..... 5/425
4,747,171 A * 5/1988 Einsele et al. ..... 5/425

(Continued)

OTHER PUBLICATIONS

Brochure (black and white) Bed Handles, Inc. Innovative Engineering, 2905 SW 19th Street, Blue Springs, MO 64015 (2 pgs) (undated).

(Continued)

*Primary Examiner*—Patricia Engle
*Assistant Examiner*—Jonathan Liu
(74) *Attorney, Agent, or Firm*—Christie, Parker & Hale, LLP.

(57) ABSTRACT

Side rail assemblies for beds are generally discussed herein with particular discussions extended to adjustable side rail assemblies. The side rail assemblies discussed herein have an under-mount frame support for supporting a brace member, which has a coupling assembly for coupling a rail guard to the brace member, and hence to the under-mount frame support. The rail guard is movable to a non-blocking position to permit ingress and egress to a bed and to a blocking position to limit ingress and egress to the bed. In the blocking position, the rail guard may be used by a user to upright himself or herself from a lying position.

20 Claims, 10 Drawing Sheets

U.S. PATENT DOCUMENTS

| | | | | |
|---|---|---|---|---|
| 4,771,492 | A * | 9/1988 | Paine et al. | 5/428 |
| 4,833,743 | A * | 5/1989 | Howell et al. | 5/426 |
| 4,993,089 | A * | 2/1991 | Solomon et al. | 5/430 |
| 5,038,430 | A * | 8/1991 | Bly | 5/425 |
| 5,640,726 | A * | 6/1997 | Fichner-Rathus | 5/426 |
| 6,134,731 | A * | 10/2000 | Thom et al. | 5/662 |
| 6,813,789 | B2 * | 11/2004 | Leoutsakos | 5/662 |
| 6,934,984 | B2 * | 8/2005 | Marsden et al. | 5/426 |
| 2002/0078502 | A1 * | 6/2002 | Baker | 5/429 |
| 2004/0040089 | A1 * | 3/2004 | Flannery et al. | 5/425 |
| 2004/0128763 | A1 * | 7/2004 | Nygren et al. | 5/426 |
| 2004/0168251 | A1 * | 9/2004 | Waldman et al. | 5/426 |
| 2004/0211002 | A1 * | 10/2004 | Tomas et al. | 5/426 |
| 2004/0250347 | A1 * | 12/2004 | Brewin et al. | 5/426 |
| 2005/0229309 | A1 * | 10/2005 | Nygren et al. | 5/430 |
| 2005/0262632 | A1 * | 12/2005 | Wu | 5/426 |
| 2006/0037140 | A1 * | 2/2006 | Clute | 5/430 |

OTHER PUBLICATIONS

Brochure (black and white) Bayport (Healthcare), "Easyleaver® Bed Grab Rail", and "Easyrail® Bed Grab Rail" (2-3 pgs) (undated).

* cited by examiner

SIDE RAIL ASSEMBLY FOR BEDS

CROSS-REFERENCE TO RELATED APPLICATION

This is an ordinary application of and claims priority to Provisional Application Ser. No. 60/627,558, filed Nov. 12, 2004, the contents of which are expressly incorporated herein by reference.

BACKGROUND

Side rail assemblies for beds are available as tools for preventing users from falling off their beds and/or for providing anchoring points so that users may grab and pull themselves up from a lying position. Because bed rails or side rails are generally available as an aftermarket add-on feature, they generally lack functionalities and sophistications. For example, most prior art bed rails have mounting features to either engage a bed frame or mount between a mattress and a box spring and have rails for gripping and pulling. However, prior art rails are generally available only in a stationary upright position so that while they provide leverage points for a user to pull himself or herself upright, the rails act as an obstruction as they cannot be moved or lowered. Some prior art rails do offer moveable rail guards for moving away from a side of a bed for ingress or regress. However, they are complicated to use and require aid from a third person.

Accordingly, there is a need for a for a side rail assembly that is easy to install, easy to use, and provides ample clearance for getting in and out of a bed.

SUMMARY OF THE INVENTION

The present invention may be implemented by providing a rail assembly for a bed, said assembly comprising two legs dimensioned to be positioned between a mattress and a supporting structure of said bed; a mounting member attached to said two legs to fix a gap between said two legs at the attached end; a rail comprising a top frame structure and a lower frame structure movably mounted to said mounting member so as to allow movement of said rail relative to said mounting member; and a coupling assembly for retaining said rail in a first raised position, said coupling assembly allowing said movement of said rail relative to said mounting member while maintaining said top end above said lower end between said first raised position to a second lowered position.

The present invention may also be practiced by providing a rail assembly for a bed, said rail assembly comprising a rail guard comprising at least two parallel tubes; a mounting assembly for mounting the rail guard to a frame support structure, said frame support structure comprising a pair of legs for positioning between a mattress and a supporting structure; and a coupling assembly for coupling the rail guard to the mounting assembly; wherein the coupling assembly comprises retaining lock pivotally attached to a bracket; the retaining lock pivoting to rotate a locking end of the retaining lock radially outwardly to move the rail guard to a first position and pivoting to rotate the locking end of the retaining lock radially inwardly to lock the rail guard in a second position.

In yet another aspect of the present invention, there is provided a rail assembly for a bed, said rail assembly comprising a rail guard means for guarding a side of a bed when moved to an upright position; a mounting means for mounting the rail guard means to a frame support means; a coupling means for coupling the rail guard means to the mounting means; wherein the coupling means adapted to move the rail guard means from the upright position to lower position along a plane transverse to a top surface of a mattress; and wherein the frame support means comprises a length that is adjustable.

In yet other aspects of the present invention, the height of a brace member relative to an under-mount frame support assembly may be adjusted.

The present invention may further be implemented by including provisions for adjusting the length of the under-mount frame support assembly for use with different size beds, such as twin, full, queen, or king beds.

In yet other aspects of the present invention, the rail assembly may include two adjustable rail guards for movably guarding two sides of a bed.

In still yet other aspects of the present invention, a rail retention mechanism is incorporated to prevent the rail assembly from shifting when used with an adjustable bed.

BRIEF DESCRIPTION OF THE DRAWINGS

These and other features and advantages of the present invention will become appreciated as the same become better understood with reference to the specification, claims and appended drawings wherein:

In the drawings, similar elements have similar reference numerals.

DETAILED DESCRIPTION OF THE INVENTION

The detailed description set forth below in connection with the appended drawings is intended as a description of the presently preferred embodiments of side rails or bed rails (herein "rails") provided in accordance with aspects of the present invention and is not intended to represent the only forms in which the present invention may be constructed or utilized. The description sets forth the features and the steps for constructing and using the rails of the present invention in connection with the illustrated embodiments. It is to be understood, however, that the same or equivalent functions and structures may be accomplished by different embodiments that are also intended to be encompassed within the spirit and scope of the invention. As shown and described herein, various embodiments of the side rail assembly include features that provide advantageous functionalities and simplicity of use for its intended use.

Figure 1:
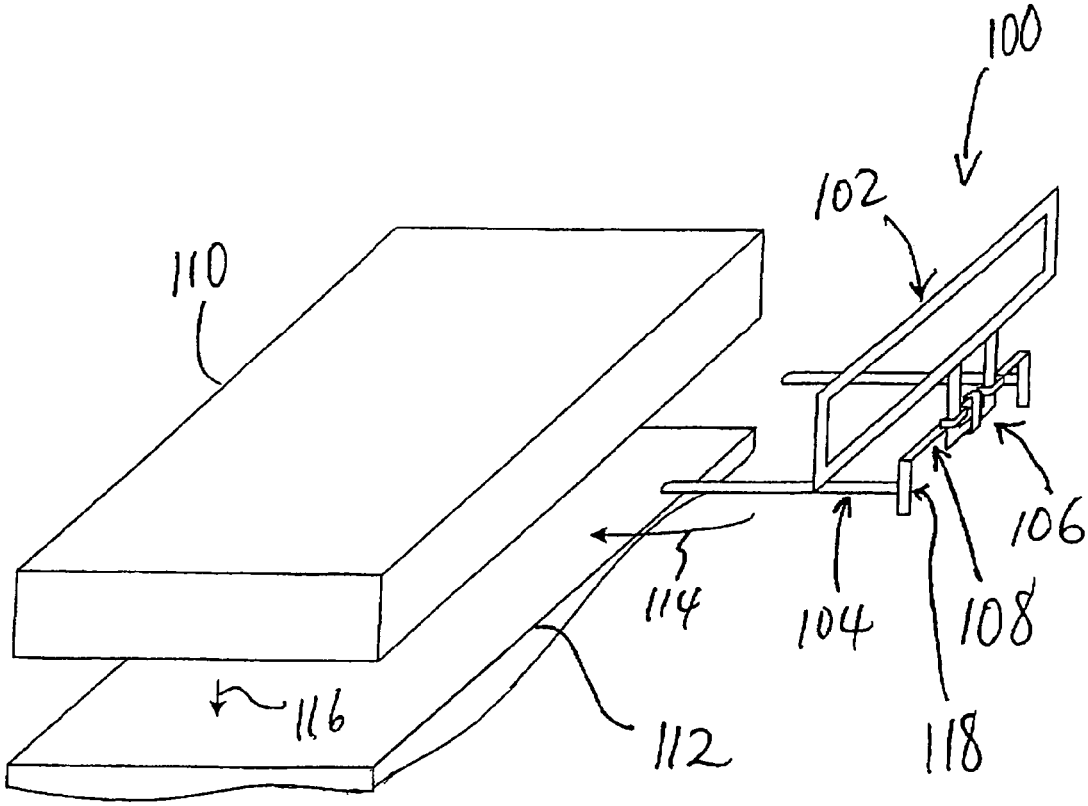
FIG. 1 shows one embodiment of a side rail assembly adapted to be inserted and retained between a mattress and a supporting structure.

FIG. 1 shows one embodiment of a bed rail assembly 100 being inserted (as indicated by an arrow 114) between a mattress 110 and a supporting structure 112. In one embodiment, the rail assembly 100 includes a pair of under-mattress legs (referred to as "leg" or "legs" herein) spaced apart a selected distance and extending generally along a transverse direction with respect to the axis of the bed (defined by head and foot of the bed). As shown in FIG. 1, the mattress 110 pressing down (as indicated by an arrow 116) on the legs 104 generally retains the legs 104 and structures coupled to them in a desired orientation with respect to the bed 100.

As shown in FIG. 1, each of the legs 104 define an interior end that is inserted under the mattress 110, and an exterior end that is located next to the side of the bed when the rail assembly 100 is installed. The rail assembly 100 further includes a brace member 108 that mechanically couples the exterior ends of the two legs 104 in a generally fixed manner. In one embodiment, each leg 104 and a portion of the brace member 108 join to form a "T" shape joint 118. Such a shape of the joint can inhibit the legs 104 from being inserted too far between the mattress 110 and the supporting structure 112.

As shown in FIG. 1, the rail assembly 100 further includes a rail 102 that is movably coupled to the brace member 108 via a coupling assembly 106. One embodiment of the coupling assembly 106 is described below in greater detail.

The rail assembly 100 having the foregoing components allows the rail 102 to be in a raised configuration to provide functions of a bed rail, and a lowered configuration to allow a bed user to get in and out of bed relatively unimpeded. As described below in greater detail, such raising and lowering of the rail 102 can be advantageously performed by one hand. Also as described below in greater detail, the rail assembly 100 having the foregoing legs 104, brace member 108, and the rail 102 movably mounted, provides a wide range of possible applications.

With respect to FIG. 1, it will be understood that the mattress 110 shown in its "floating" position is for the purpose of demonstrating where the rail assembly 100 is to be positioned. Such a depiction should not be construed as requiring the mattress 110 to be separated substantially from the supporting structure 112 to install the rail assembly. In a typical use, the legs 104 can be inserted between the mattress 110 and the supporting structure 112 simply by partially lifting a portion of the mattress 110. In some applications, the legs 104 may be inserted and urged inward by simply pushing on the rail assembly 100.

Figure 2:
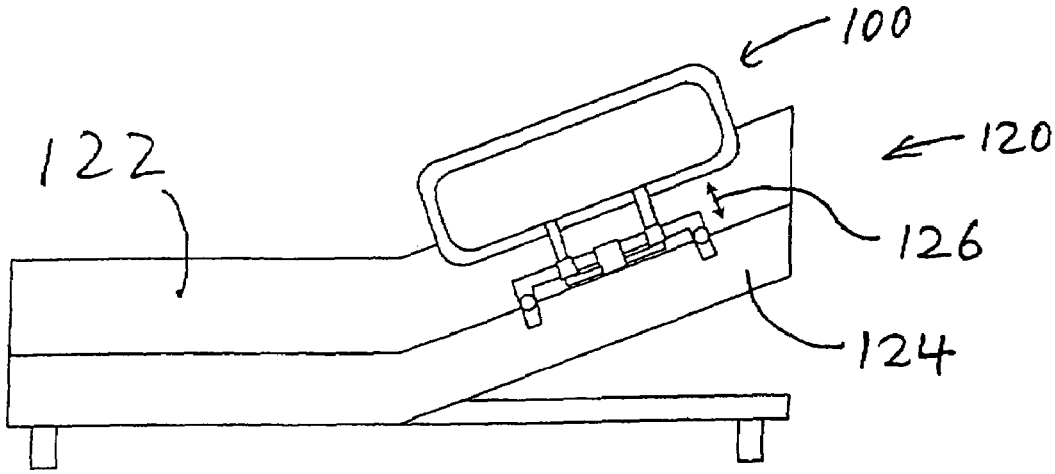
FIG. 2 shows that the side rail assembly can be used for home-style adjustable beds having a mattress supported by a base, in either raised or horizontal orientation.

FIG. 2 shows that the rail assembly 100 can be used on a homestyle electrically adjustable-type bed 120. Such a bed typically includes a mattress 122 supported by a base 124. A portion of the base 124 can be raised to angle the head portion of the mattress 122 to angle with respect to the horizontal line, thereby allowing the bed-user to be in a partially upright position.

As shown in FIG. 2, one embodiment of the rail assembly 100 is shown to be installed in the homestyle adjustable-type bed 120. In such an installation, the legs 104 can be positioned and supported between the mattress 122 and the base 124. The portion of the mattress 122 above the legs 104 provides the downward pressure that frictionally retains the legs 104, thereby allowing the rail 102 of the rail assembly 100 to move generally perpendicularly (as indicated by an arrow 126) to the corresponding portion of the base 124 and the mattress 122.

Figure 3:
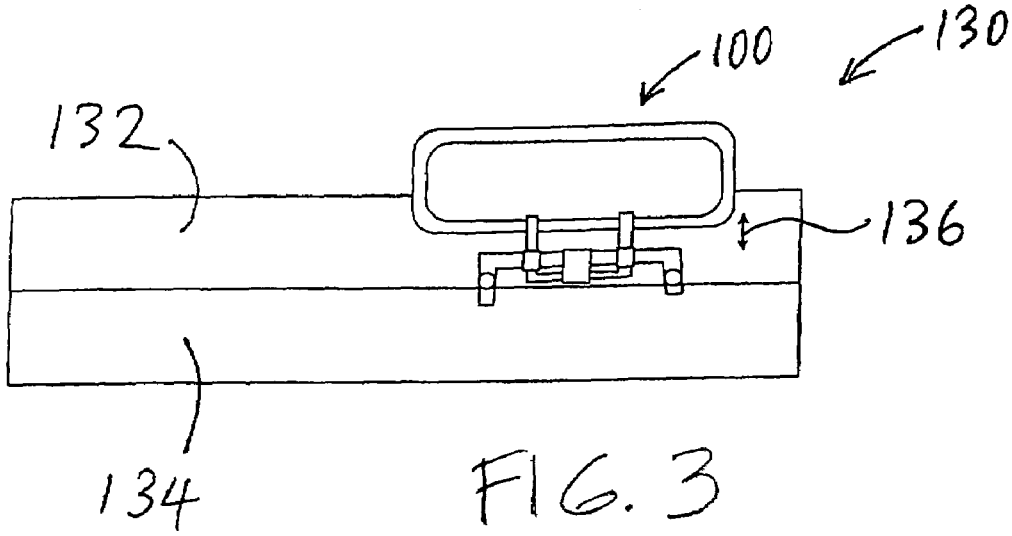
FIG. 3 shows that the side rail assembly can be used for beds having a mattress supported by a structure such as a box spring or a platform.

FIG. 3 shows that the rail assembly 100 can be used on a bed 130 having a mattress 132 and a supporting structure 134 such as a box spring or a platform. In one embodiment, the legs 104 can be positioned between the mattress 132 and the box 134. In such an application, the legs 104 are supported by the upper surface of the box 134. The mattress 132 above the legs 104 provides the downward pressure that frictionally retains the legs 104, thereby allowing the rail 102 of the rail assembly 100 to move generally perpendicularly (as indicated by an arrow 136) to the box 134 and the mattress 132.

One can see from FIGS. 2 and 3 that a first plane defined by the legs 104 of the rail assembly 100 is generally parallel to a second plane between the supporting/retaining portion of the mattress and the supporting structure. As such, the rail 102 of the rail assembly 100 moves generally perpendicular to the second plane of the bed. Furthermore, the legs 104 of the rail assembly 100 are not fixedly attached to the mattress or the supporting structure (base 124 in FIG. 2, and box 134 in FIG. 3). Thus, the rail assembly 100 is able to adjust its orientation as the angle of the bed is adjusted, thereby providing the rail 102 that generally maintains its position with respect to the top portion of the mattress. Moreover, the "lowering" or "raising" of the rail 102 with respect to the top portion of the mattress also generally remains the same.

Figure 4A:
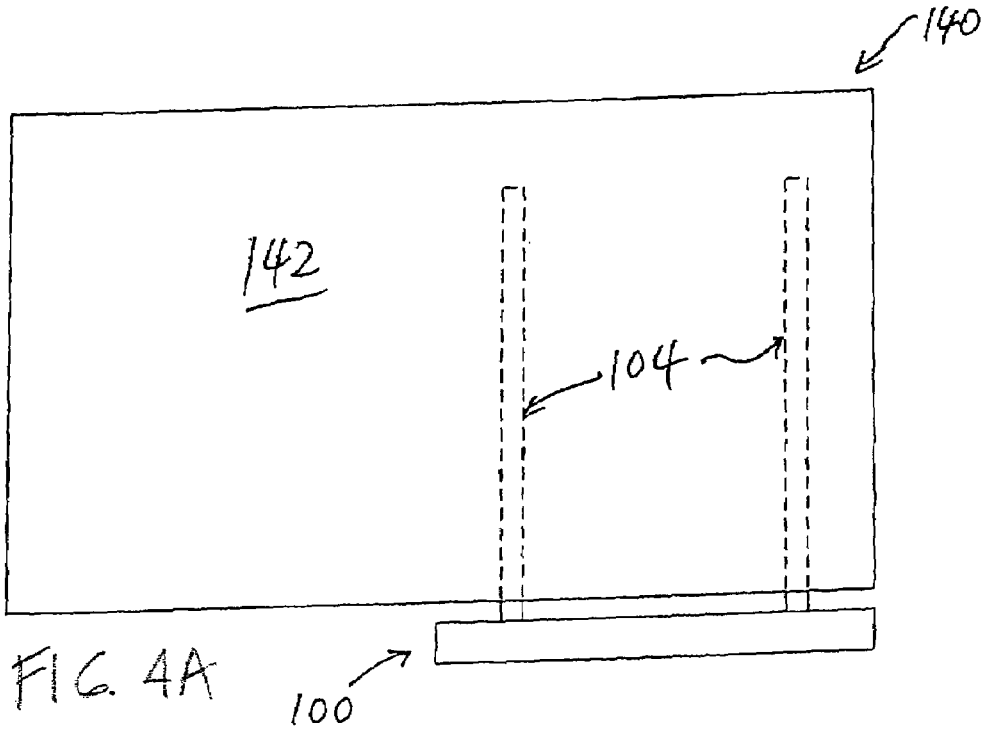
FIGS. 4A and B show that the side rail assembly can be installed on either side of a bed.
Figure 4B:
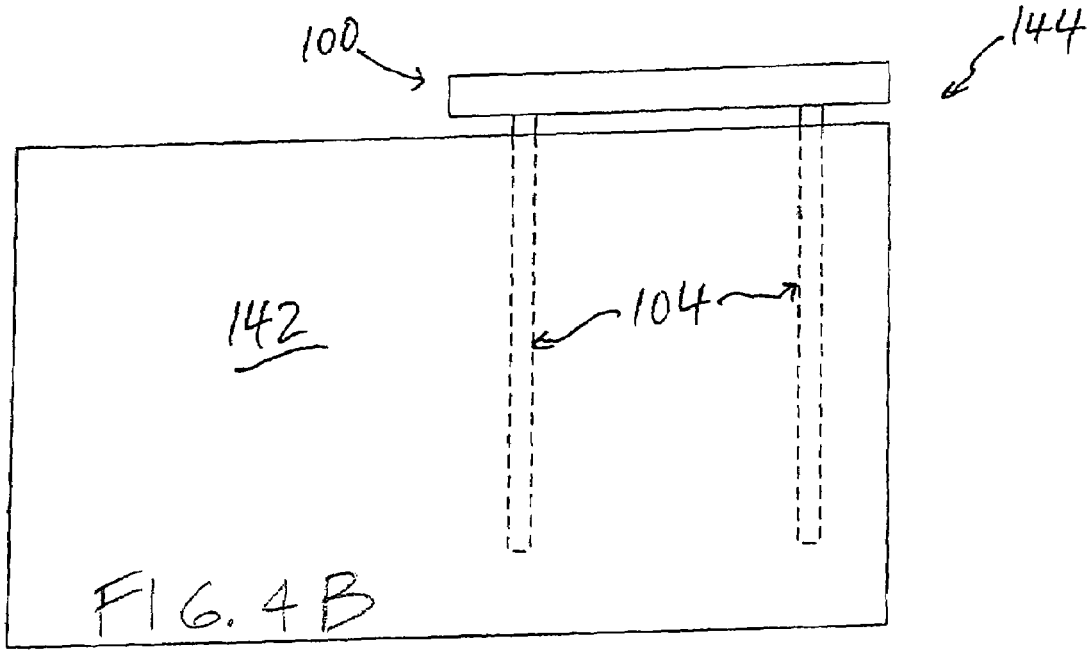

FIGS. 4A and B show that the rail assembly 100 having the foregoing features can be mounted to either side of a bed 142 in a relatively easy manner. FIG. 4A shows that the legs 104 are inserted from the left side (of a user lying on his/her back on the bed) so that the movable rail is positioned on the left side of the bed 142. Because the legs 104 are not fixedly attached to the bed 142, it can be removed from the bed relatively easily, and installed from the right side of the bed 142 (FIG. 4B).

Figure 5A:
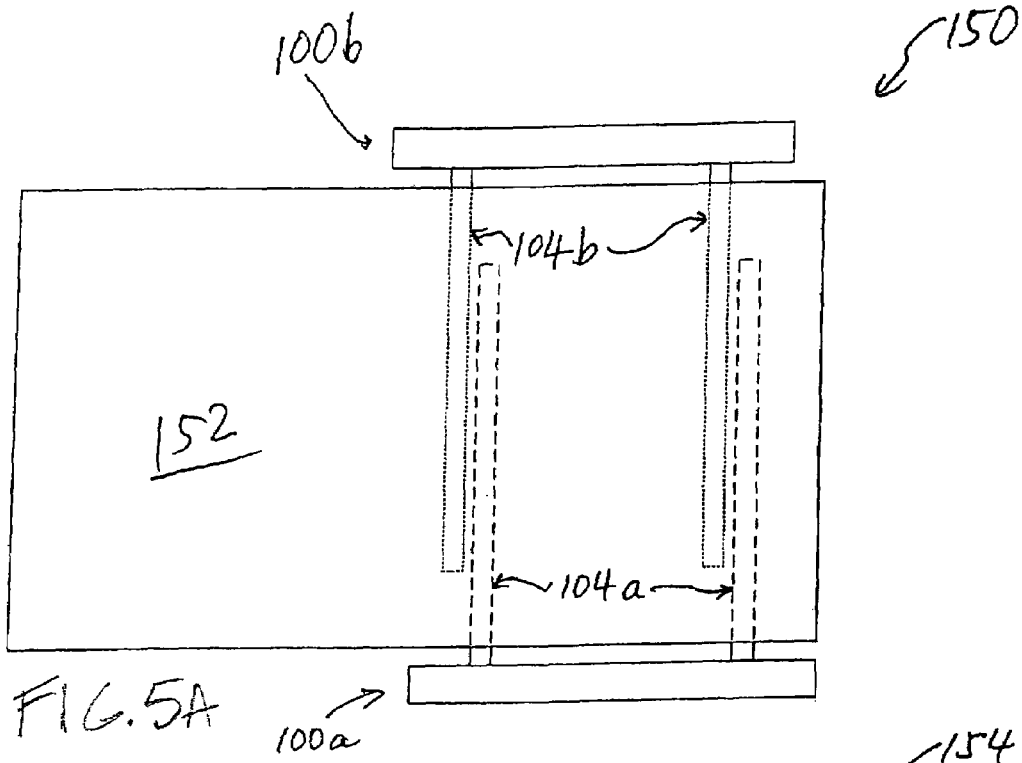
FIGS. 5A and B show that two side rail assemblies can be installed on two sides of the bed so that a user may grab the guard rail from either side to upright himself or herself.
Figure 5B:
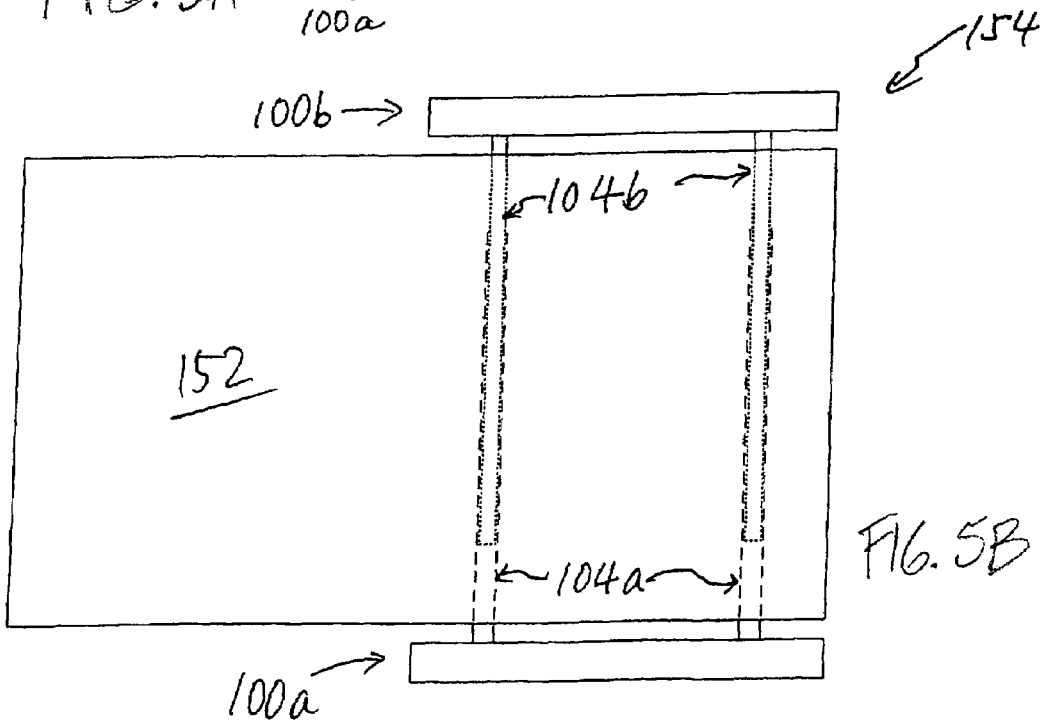

FIGS. 5A and B show that rail assemblies 100 can be installed on both sides of a bed 152. In one embodiment, as shown in FIG. 5A, two rail assemblies 100*a* and 100*b* are substantially similar, and their corresponding legs 104*a* and 104*b* are offset and interleave with each other. In one embodiment, as shown in FIG. 5B, the first rail assembly 100*a* is shown to have legs 104*a* that are dimensioned to receive the legs 104*b* of the second rail assembly 100*b*. Thus, such telescoping/retracting feature of the first and second sets of legs 104*a* and 104*b* allow the two rail assemblies 100*a* and 100*b* to be installed on both sides of the bed 152 at a substantially similar location along the bed's axis.

From the foregoing, one can see that the bed rail assembly of the present teachings provides a wide range of possible installation configurations. Such ease and flexibility of installation, combined with the movable rail, provides novel and advantageous functional features of the rail assembly disclosed herein.

Figure 6:
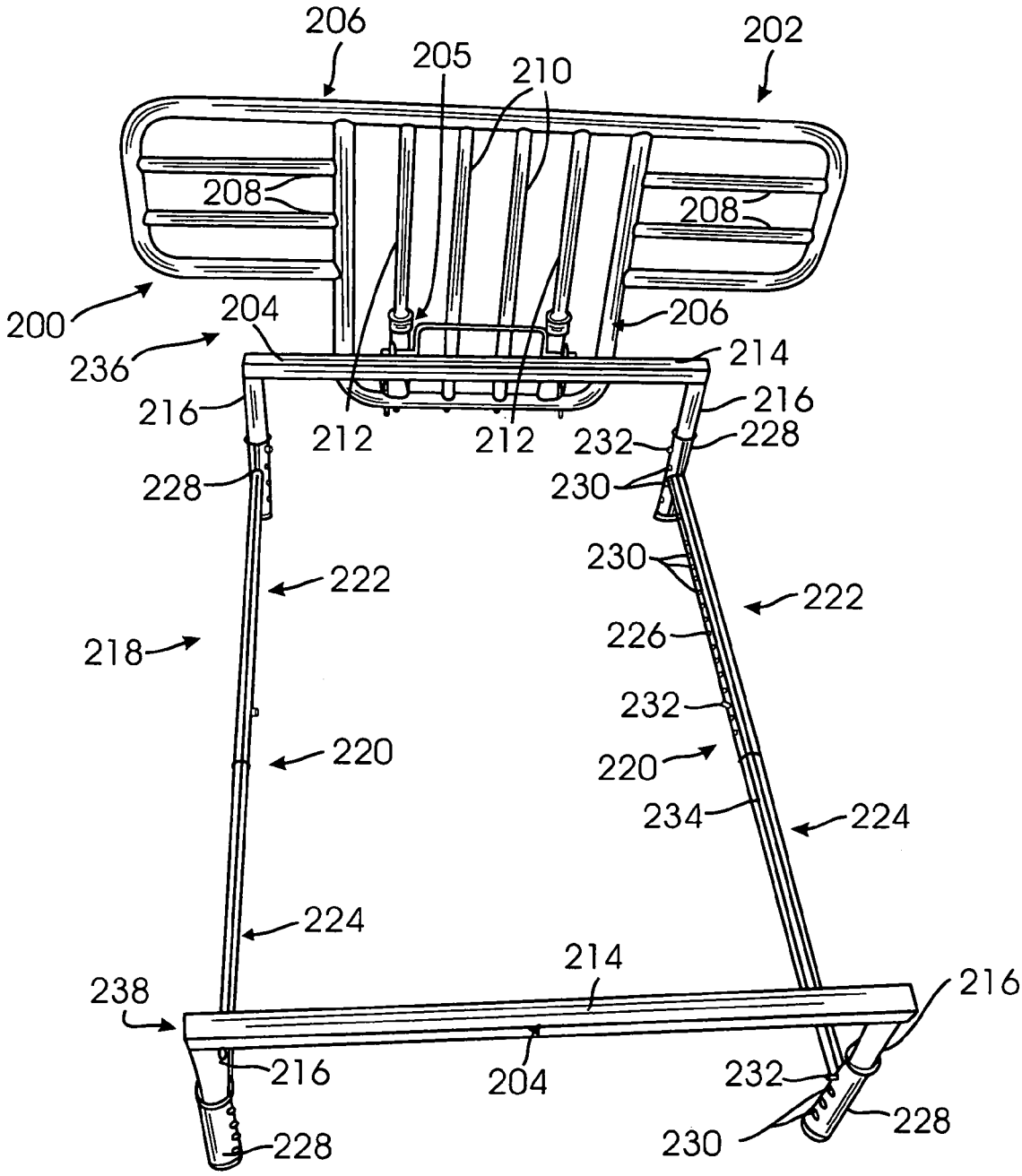
FIG. 6 shows a rail assembly mounted to an under-mount frame support.

FIG. 6 shows one embodiment of a bed rail assembly 200 that includes the advantageous features described above. In accordance with aspects of the present invention, the rail assembly 200 includes a rail guard 202 movably coupled to a brace member 204 via a coupling assembly 205. The rail guard 202 is configured to prevent a user from falling off a bed and/or provide a leverage point for a user to pull himself or herself upright. The rail guard 202 comprises a plurality of welded tubing joints, including a perimeter tubing 206 and a plurality of horizontal 208 and vertical 210 tubing joints, referred to as internal tubing joints, forming a truss structure. The horizontal and vertical designations are made with reference to the horizontal plane defined by a mattress 110 (FIG. 1), to which the rail assembly 200 is configured to be used in combination with. Optionally the vertical tubing joints 212 and/or the horizontal tubing joints 208, i.e., the internal tubing joints, may be bolted or fastened to the perimeter tubing 206 by incorporating a threaded receptacle and using a threaded screw to fasten the horizontal or vertical joint to the perimeter joint, as further discussed below.

In one exemplary embodiment, the brace member 204 comprises a horizontal tubing joint 214 and two extension legs 216 located at two opposite ends thereof forming an upside-down U-shape member. However, any configuration is possible provided the brace member 204 includes a section for attaching to a coupling assembly 205 and a section for attaching to an under-mount frame support 218, which is a structure for supporting the brace member 204 and the rail guard 202 and is mounted between a mattress 110, 122, 132 and a supporting structure or a base 124, 134.

In one exemplary embodiment, the under-mount frame support 218 comprises a pair of adjustable brackets 220 with each adjustable bracket comprising a first support member 222 and a second support member 224 in telescoping relationship. The first support member 222 comprises an under-mount arm 226 and a receiving joint 228 forming a T-shape joint at the end near the receiving joint 228. The T-shape joints are configured to straddle two sides of the mattress and box spring or platform support to prohibit the under-mount frame support 218 from sliding laterally. The receiving joint 228 is adapted to receive an extension leg 216 of the brace member 204 and preferably has the same shaped configuration as the extension leg 216 for close tolerance mating, which in the present embodiment comprises one cylindrical joint telescopically disposed within another cylindrical joint. In a preferred embodiment, the receiving joint 228 incorporates a plurality of slots or holes 230 and the extension leg 216 incorporates a push button 232 biased or urged by a resilient member, such as a coil spring or a leaf spring (not shown), for allowing the depth in which the extension leg 216 projects into the receiving joint 228 to be adjusted. Once a proper height is obtained, such as positioning the horizontal tubing joint 214 at or slightly below the top surface of a mattress, the two components are fixed to one another by engaging the push button 232 to a matching slot or hole 230.

In one exemplary embodiment, the second support member 224 comprises an under-mount arm 234 connected to another receiving joint 228, which comprises a plurality of slots or holes 230. The under-mount arm 234 of the second support member 224 is configured to project into the under-mount arm 226 of the first support member 222 in a telescoping relationship. In a preferred embodiment, the telescoping of one under-mount arm 226 relative to the other under-mount 234 is adjustable by incorporating a plurality of slots or holes 230 and a push button 232. Obviously, the adjustable bracket 220 may be orientated in reversed fashion by allowing the under-mount arm 226 of the first support member 222 to project into the under-mount arm 234 of the second support member 224.

As clearly shown in FIG. 6, the brace member 204 fixes the gap or distance between the two adjustable brackets 220 of the under-mount frame support 218 at the operating end 236. As used herein, the operating end 236 is the end where the rail assembly 200 is mounted and where a user generally mounts and dismounts a bed. The gap or spacing between the two adjustable brackets 220 on the inactive end 238 is similarly fixed by a second brace member 204, which has a pair of extension legs telescopically projected into the two receiving joints 228. The inactive end 236 may be an end located on a side of a bed that is next to a wall or some other structure, which makes that side of the bed inactive for purposes of ingress and regress. The inactive end may also simply be the end without a rail guard.

In use, the two adjustable brackets 220 are telescopically adjusted to accommodate the width of a bed, which is positioned widthwise between the two receiving joints 228 of both adjustable brackets 220. More specifically, after adjusting the amount of overlapping between the two under-mount arms 226, 234 of both adjustable brackets 220, the brackets are placed under a mattress (e.g., FIG. 5B) and the mattress rests on top of the brackets with the four receiving joints 228 straddling both sides of the mattress. The two brace members 204 are then mounted to the receiving joints 228 to fix the spacing at the operating end 236 and the inactive end 238 of the under-mount frame support 218. Depending on the thickness of the mattress, the amount of overlapping between the extension legs 216 and the four receiving joints 228 may be adjusted so that the horizontal tubing joints 214 of one or both brace members 204 are positioned at or slightly below the upper surface of a mattress to facilitating getting into and out of bed.

The rail assembly 200 shown in FIG. 6 is adapted for use with a bed that is positioned near a wall or some other structure so that access to the bed is limited to one side of the bed. If a bed is placed away from a wall so that two sides of the bed are accessible, a second rail guard 202 in combination with a brace member 204 may be used at the inactive end of the under-mount frame support 218 so that it has two operating ends 236. Hence, a user may mount and dismount a bed from any side of the two length-wise sides of the bed by adjusting the corresponding rail guard 202 up or down, as further discussed below.

In one embodiment, the rail 202, brace member 204, vertical rods 210, and the legs 220, 222 are formed from hollow tubular steel so as to provide structural strength while having manageable weight. In one embodiment, the aforementioned steel tubes are joined by welds at couplings that are intended to be substantially fixed. In one embodiment, the exterior surfaces of the aforementioned steel tubes are finished to be substantially smooth (e.g., chromed, polished, or painted) to allow relatively easy cleaning and disinfecting. It will be appreciated that any other material and configuration of such material can be implemented to form the aforementioned structures without departing from the spirit of the present teachings.

Figure 7:
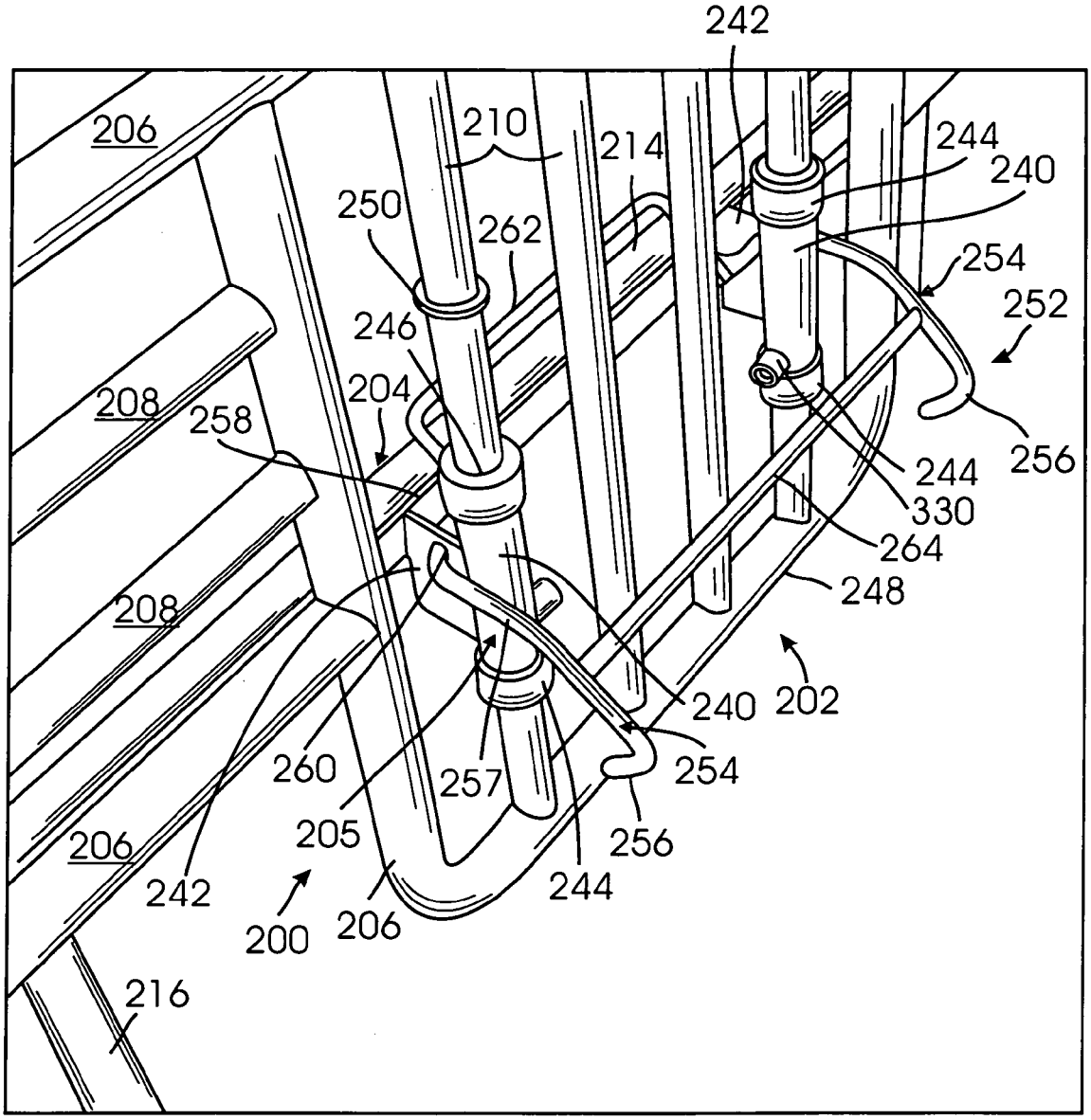
FIG. 7 is a close-up view of the rail assembly of FIG. 6.

FIG. 7 is a close-up view of the rail assembly 200 viewed from the operating end 236 towards the inactive end of FIG. 6. In one exemplary embodiment, the coupling assembly 205 comprises two coupling tubes 240 with each tube comprising a mounting bracket 242 and a pair of coupling end guards 244. In one exemplary embodiment, the end guards 244 are made from a thermoplastic or rubber material with each being adapted to frictionally engage the exterior surface of the coupling tube 240. The end guards 244 each comprises an opening 246 sized to receive a vertical joint 210.

In one exemplary embodiment, each mounting bracket 242 is welded to the coupling tube 240 and to the brace member 204, more specifically, to the horizontal tubing joint 214 of the brace member 204. Thus, each mounting bracket 242 secures each coupling tube 240 and fixes each coupling tube to the brace member 204. The rail guard 202 is mounted to the coupling assembly 205 by passing two vertical tubing joints 210 through the two coupling tubes 240 and then fastening the two tubing joints 210 to the perimeter tubing 206 of the rail guard 202, as further discussed below. Thus, the rail guard 202 is movable relative to the coupling assembly 205, and hence to the brace member 204, by sliding the two vertical joints 210 up or down relative to the two coupling tubes 240. As used herein, the term up is defined by movement of the lower perimeter tubing 248 towards the lower coupling end guards 244 and down is defined by movement of the lower perimeter tubing 248 away from the lower coupling end guards. In one exemplary embodiment, one or more cushion washers 250 are incorporated for cushioning the impact of the upper coupling end guards 244 from impact by the upper perimeter tubing 206 when the rail guard 202 is lowered to allow ingress or egress from the bed.

In one exemplary embodiment, a rail retainer 252 is incorporated for retaining the rail guard 202 in the upright guarded position (FIG. 6). The rail retainer 252 comprises two hook members 254 each pivotally connected to the mounting bracket 242. In one exemplary embodiment, each hook member 254 comprises a hook end 256 and an extension pin 258 that projects through an opening 260 on the mounting bracket 242. The extension pin 258 allows the hook member 254 to pivot about the extension pin 258 to rotate the hook member 254 relative to the mounting bracket 242. The extension pin 258 is spaced apart from the hook end 256 by an arm 257, which has a length of sufficient dimension to permit the hook end 256 to hook around the bottom perimeter tubing 248, as further discussed below.

In one exemplary embodiment, a first cross-bar 262 is connected to the two ends of the two extension pins 258 on the two hook members 254. The first cross-bar 262 is located on the side of the guard rail 202 closest to brace member 204. A user may grab and manipulate the first cross-bar 262 to pivot the two hook members 254 about the two extension pins 258, which will cause the two hook ends 256 to swing radially outwardly relative to the lower perimeter tubing 248. A second cross-bar 264 connects the two hook members 254 by connecting to both arm members 257. The second cross-bar 264 is located to the side of the rail guard 202 further away from the brace member 204 and is configured to be used by a person outside of the bed, such as an assistant or a nurse, to pivot the two hook ends 256 of the two hook members 256 away from the lower perimeter tubing 248, which shares the same function as the first cross-bar 262.

Figure 8:
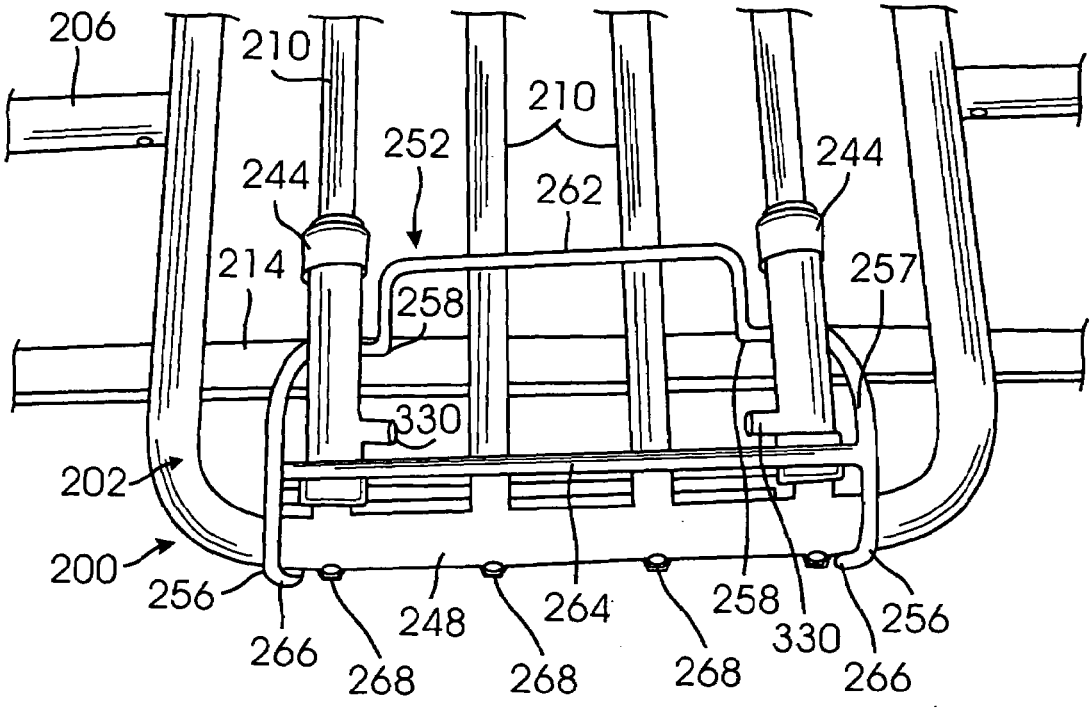
FIG. 8 is another close-up view of the rail assembly of FIG. 6.

FIG. 8 shows the rail assembly 200 in an upright guarded position by hooking the hook ends 256 below the lower perimeter tubing 248. In one exemplary embodiment, the rail retainer 252 is off-set about the two extension pins 258. Thus, the lower section of the rail retainer 252 below the two extension pins 258 is heavier than the upper section above the two extension pins. This off-set configuration allows the rail retainer 252 to normally pivot the hook ends 256 inwardly toward the lower perimeter joint 248 simply due to gravity. In practice, as the rail guard 202 is pulled upwardly, the lower perimeter joint 248 contacts the bottom side 266 of the two hook ends 256 and deflects the hook ends outwardly away from the lower perimeter joint 248. As the rail guard 202 moves further upward, gravity causes the hook ends 256 to swing back to latch or hook the lower perimeter joint 248, as shown in FIG. 8. In an alternative embodiment, a user may pivot the rail retainer 252 by manipulating the first or second cross-bar 262 or 264 to accomplish the same task.

Figure 9:
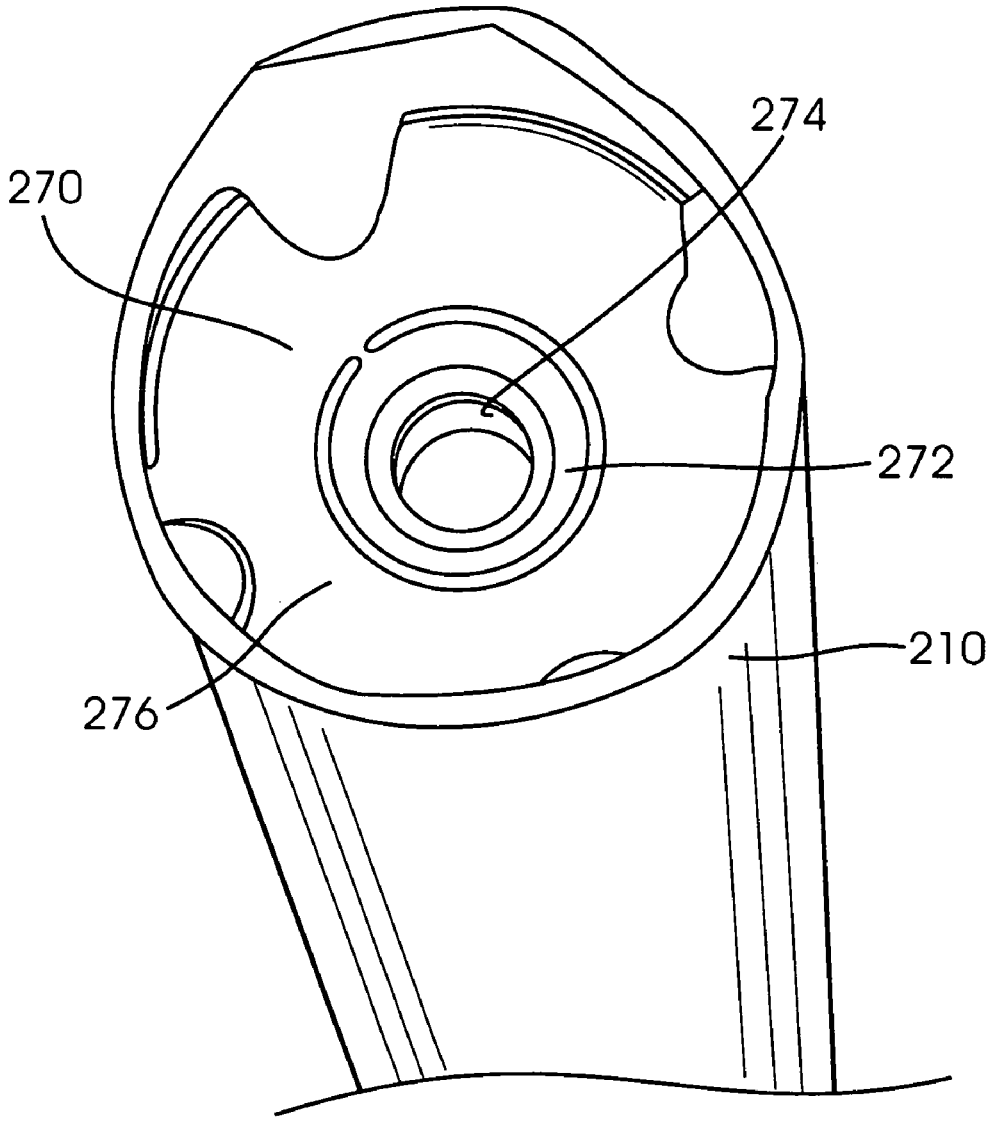
FIG. 9 is an end view of a vertical tubing joint showing a threaded boss for threadinly engaging the vertical tubing joint to a perimeter joint.
Figure 9A:
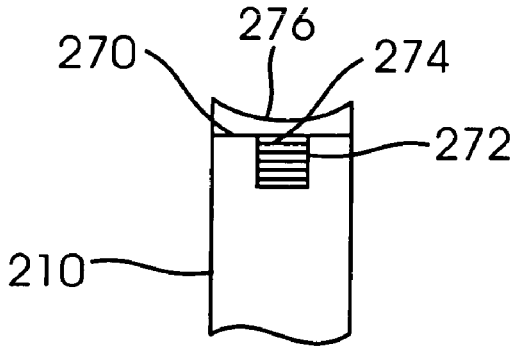
FIG. 9A is a cross-sectional side view of the threaded boss of FIG. 9.

As also shown in FIG. 8, the vertical tubing joints 210 are connected to the perimeter tubing joint 206 using fasteners 268 inserted through openings on the perimeter joint and fastened against corresponding threaded receptacles located inside the vertical joints. With reference to FIGS. 9 and 9A, in one exemplary embodiment, a disc 270 comprising a nut 272 comprising a threaded bore 274 is incorporated inside an end opening 276 of each vertical tubing joint 210 for threaded engagement using a fastener or screw 268 (FIG. 8). In an alternative embodiment, the vertical tubing joints 210 are welded to the perimeter joint 206 after the coupling assembly 205 is mounted thereto so that the fasteners may be eliminated. In yet another embodiment, a combination of fasteners and welded joints are used to attach a perimeter tubing to the plurality of horizontal and vertical tubing joints. Still alternatively, angled tubing joints rather than or in addition to vertical and horizontal tubing joints may be incorporated.

Figure 10:
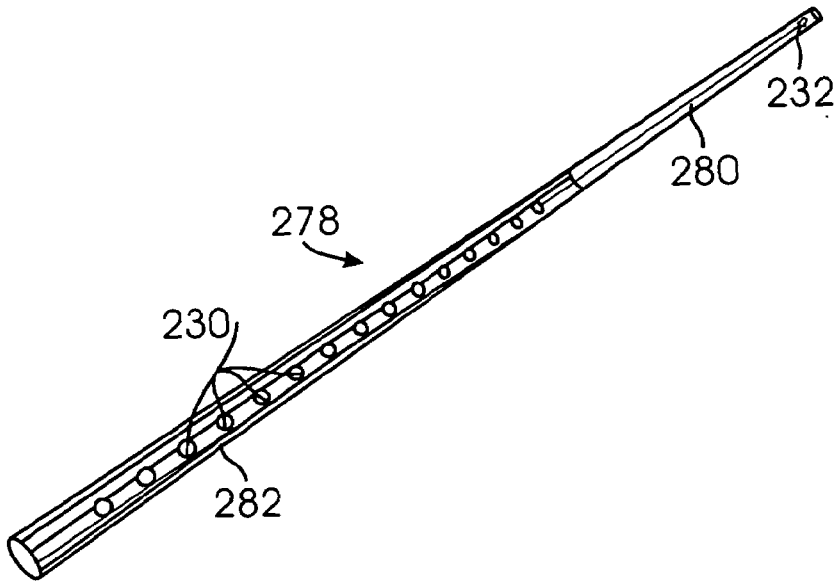
FIG. 10 shows a frame extender provided in accordance with aspects of the present invention.

FIG. 10 is a semi-schematic perspective view of an under-mount frame extender 278 provided in accordance with aspects of the present invention. The frame extender 278 is configured to cooperate with an adjustable bracket 220 to lengthen the gap between one receiving joint 228 to another receiving joint 228 of an adjustable bracket 220 (FIG. 6) to thereby permit the adjustable bracket 220 to accommodate larger size beds, having larger widths. In one exemplary embodiment, the frame extender 278 comprises a male end 280 comprising a spring loaded push button 232 and a female end 282 comprising a plurality of slots or holes 230. When used, the male end 280 is configured to project into the under-mount arm 226 of the first support member 22 while the female end 282 is configured to receive the under-mount arm 234 of the second support member 224 (FIG. 6). The gap between the two receiving joints 228 (FIG. 6) may be adjusted by manipulating the push buttons 232 on the frame extender 278 and the second support member 224 to engage the desired slots or holes 230, which correspond to a desired gap.

Figure 11:
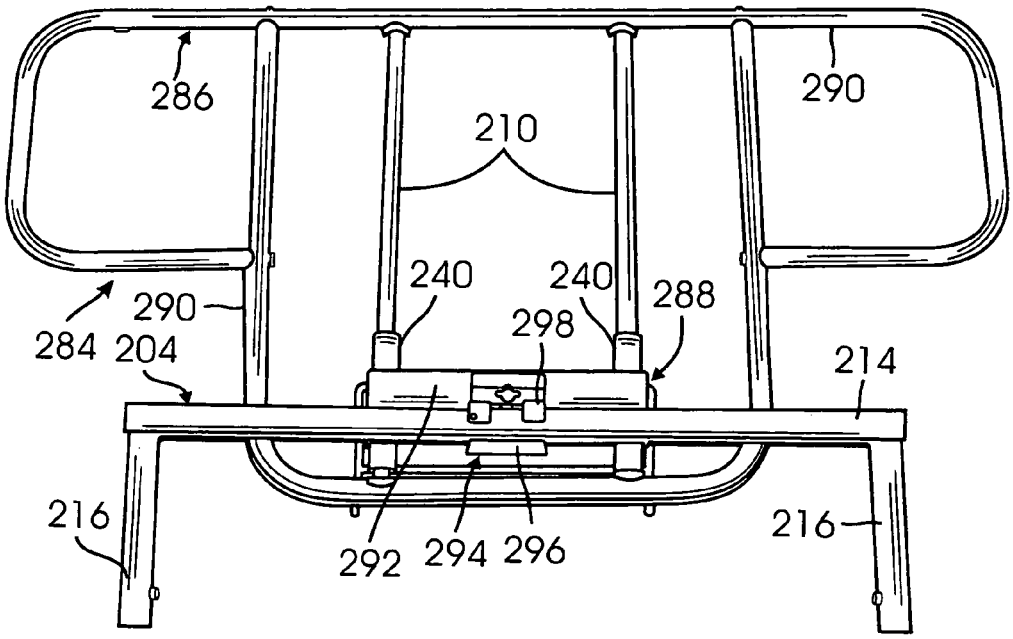
FIG. 11 shows an alternative rail assembly provided in accordance with aspects of the present invention.

FIG. 11 is a semi-schematic front view of an alternative rail assembly provided in accordance with aspects of the present invention, which is designated 284. In one exemplary embodiment, the alternative rail assembly 284 comprises a rail guard 286 removably attached to a brace member 204 via a coupling assembly 288. As previously discussed, the brace member 204 is configured to attach to an under-mount frame support 218 (FIG. 6).

Like the rail guard 202 discussed with reference to FIG. 6, the alternative rail guard 286 comprises a perimeter tubing joint 290 and a plurality of vertical tubing joints 210 forming a truss structure. Although no horizontal tubing joints are shown, they may be incorporated without deviating from the spirit and scope of the present invention. In one exemplary embodiment, the vertical tubing joints 210 and the perimeter tubing joint 290 are connected to one another using fasteners and threaded receptacles, as previously discussed. However, the various tubing pieces may be welded and the fasteners and threaded receptacles eliminated.

In one exemplary embodiment, the coupling assembly 288 comprises a pair of coupling tubes 240 joined to a mounting plate 292 and a gripping device 294, which is also mounted to the mounting plate 292. As discussed further below with reference to FIG. 12, the gripping device 294 comprises a lower jaw 296 and an upper jaw 298 configured to cooperate to clamp or grip a horizontal tubing joint 214 of a brace member 204 to secure the rail guard 286 to the brace member 204. The rail guard 286 is thus secured to the brace member 204 but is movable relative to the brace member and the coupling assembly 288 by sliding the two vertical tubing joints 210 relative to the two coupling tubes 240 located on the coupling assembly 288, as further discussed below.

Figure 12:
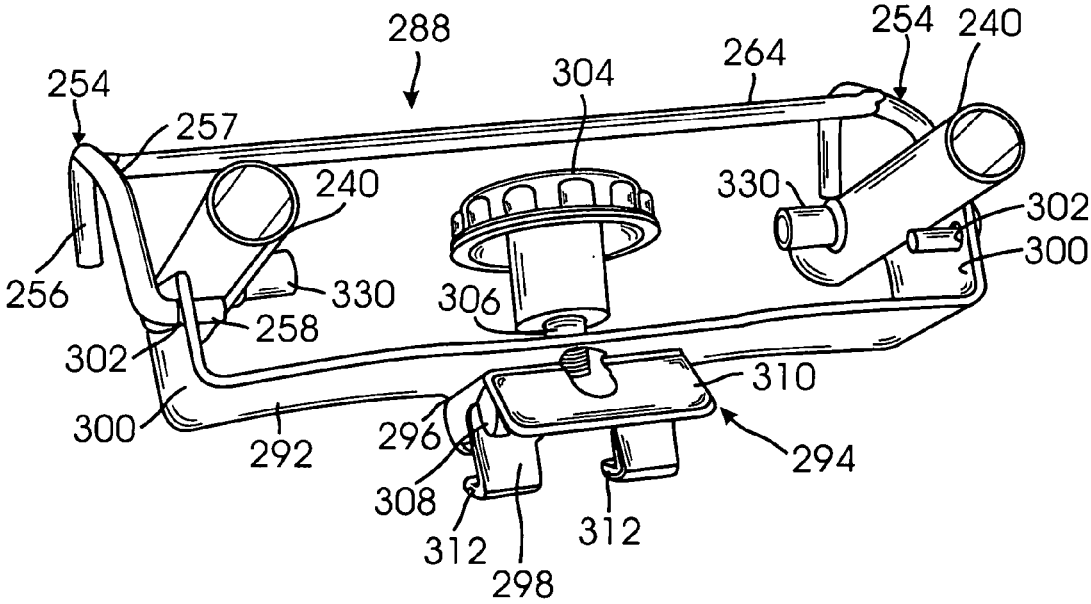
FIG. 12 is a close-up view of a coupling assembly incorporated in the rail assembly of FIG. 11.

FIG. 12 is a top view of the coupling assembly 288 of FIG. 11 shown without the rail guard 286 and the brace member 204. As shown, the mounting plate 292 comprises two end plates 300 fixedly secured to two coupling tubes 240, which are shown without coupling end guards 244 but may be included. The end plates 300 each includes an opening 302 for receiving an extension pin 258 located on the two hook members 254. A cross-bar 264 joins the two hook members 254 together so that they move in unison. The cross-bar 264 also provides a location or structure for grabbing and manipulating by an assistant or a user. A second cross-bar may also be incorporated in a similar manner as shown for cross-bar 262 of FIG. 7.

In one exemplary embodiment, the gripping device 294 comprises a turning knob 304, which is connected to a threaded pin 306 that is threaded to a threaded bar stock 308, to which the upper jaw 298 is attached. The gripping device further includes a guide plate 310 positioned at an angle to and attached to the mounting plate 292. In use, when the turning knob 304 is rotated, the threaded pin 306 threadedly engages the threaded bar stock 308 and moves the threaded bar stock 308 closer to the knob 304. Because the threaded bar stock 308 rides against the inclined guide plate 310, the upper jaw 298, which is attached to the bar stock 308, moves downward and inward towards the knob 304.

Again with reference to FIG. 11, when the horizontal tubing joint 214 is mounted between the upper 298 and the lower jaw 296, the turning action on the knob 304 forces the upper jaw 298 to clamp down on the tubing joint 214 to pin the tubing joint between the two jaws. At the same time, the inward motion of the upper jaw 298 causes the claw 312 at the end of the upper jaw 298 to grip against a side surface of the horizontal bar. Although a single gripping device 294 is shown, two or more gripping devices 294 may be incorporated to secure the coupling assembly 288 to the brace member (FIG. 11) at two or more locations for a stronger and more evenly distributed connection. Still alternatively, rather than a turning knob in combination with a threaded pin, a lever with a cam and follower may be incorporated without deviating from the spirit and scope of the present invention.

Figure 13A:
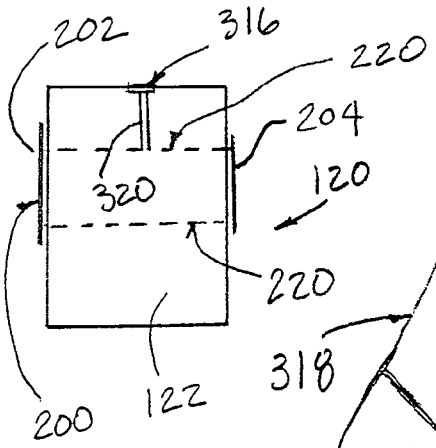
FIG. 13A shows the rail retention mechanism of FIG. 13 in used with a rail assembly.
Figure 13:
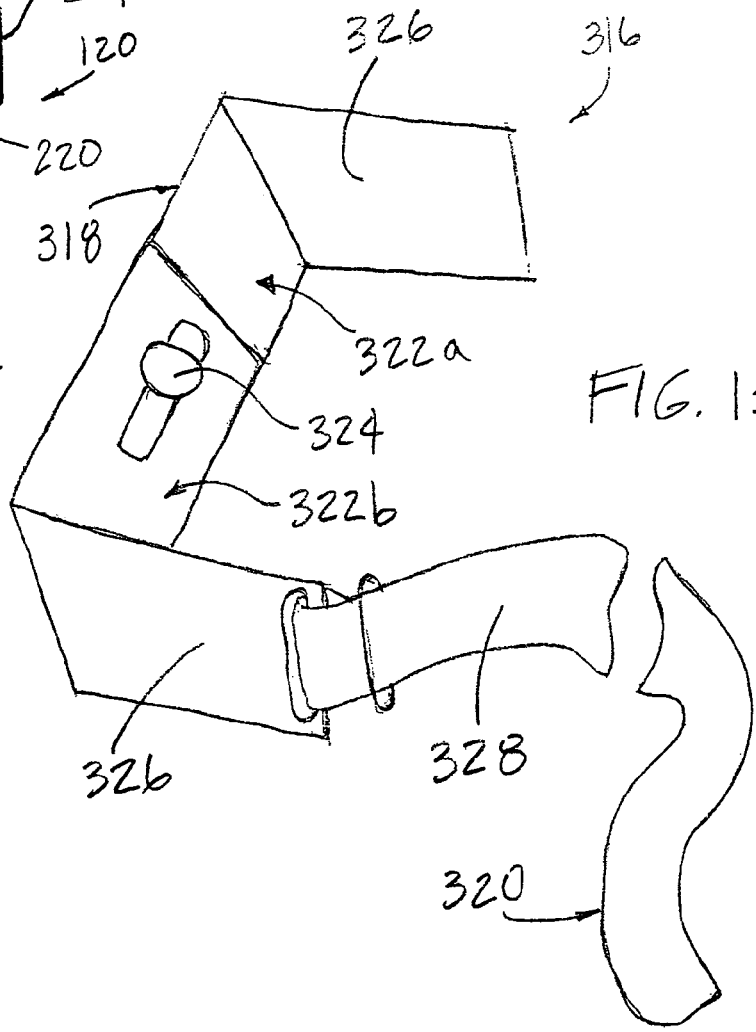
FIG. 13 shows a rail retention mechanism provided in accordance with aspects of the present invention.

FIG. 13 is a semi-schematic perspective view of a rail assembly retention mechanism 316 provided in accordance with aspects of the present invention. In one exemplary embodiment, the retention mechanism 316 comprises a hook end 318 for hooking the retention mechanism to a mattress 122 (FIG. 13A) and a strap end 320 for strapping to an adjustable bracket 220. Alternatively, the hook end 318 may be hooked to a head side or top side of a box spring or a mattress supporting surface. With reference to FIGS. 2 and 13A, the retention mechanism 316 is configured to retain the rail assembly 200 in position when the same is used with an adjustable type bed 120. As shown in FIG. 2, when the bed 120 is inclined, the rail assembly 200, without the retention mechanism 316, may slide due to gravity. With the retention mechanism 316, a strap may be placed around one or both adjustable brackets 220 to secure the same from sliding by anchoring the other end of the strap 316 (i.e., the hook end 318) to the bed.

Referring again to FIG. 13, in one exemplary embodiment, the hook end 318 comprises a pair of adjustable L-brackets 322*a*, 322*b* that is adjustable depending on the thickness of a supporting surface or mattress and lockable using a fastener 324 to secure the two L-brackets to one another once a proper width between the two plates 326 has been adjusted to accommodate the thickness of the supporting surface or mattress. A VELCRO® strap 328 having a hook and loop tape is preferably used to wrap around one or both adjustable brackets 220 to prevent the rail assembly 200 from sliding.

Figure 14:
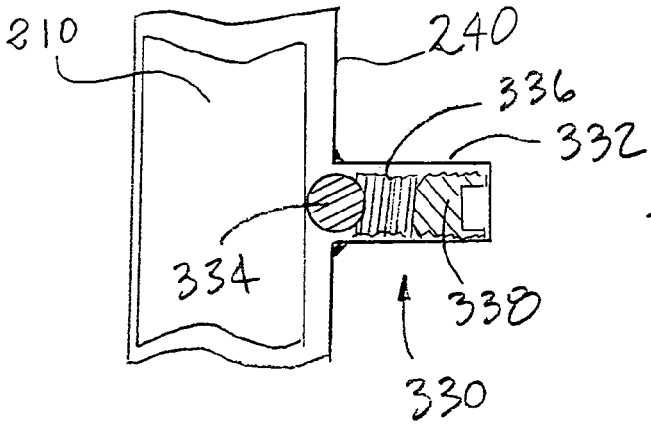
FIG. 14 is a cross-sectional side view of a breaking mechanism provided in accordance with aspects of the present invention.

FIG. 14 is a semi-schematic partial cross-sectional side view of a coupling tube 240, which is part of a coupling assembly 205, 288 (See, e.g., FIGS. 7, 8, and 12), provided in accordance with aspect of the present invention. The coupling tube 240 incorporates a braking mechanism 330 to frictionally engage with a vertical joint 210 on a rail guard 202. If incorporated, the breaking mechanism allows the rail guard 202 to be raised or lowered in a breaking manner. In one exemplary embodiment, the braking mechanism 330 comprises a well 332, which may be a steel tube, welded to the coupling tube 240. Internally, a ball bearing 334 is compressed by a coil spring 336, which has its tension controlled by a screw 338. As the screw 338 is tightened within the well 332, it compresses the spring 336, which then pushes against the ball bearing 334 and in turn against a side of the vertical joint 210 to frictionally engage the vertical joint.

Although the above-disclosed embodiments have shown, described, and pointed out the fundamental novel features of the invention as applied to the above-disclosed embodiments, it should be understood that various omissions, substitutions, and changes in the form of the detail of the devices, systems, and/or methods shown may be made by those skilled in the art without departing from the scope of the invention. Consequently, the scope of the invention should not be limited to the foregoing description, but should be defined by the appended claims.

What is claimed is:

1. A rail assembly for a bed, said assembly comprising:

two legs dimensioned to be positioned between a mattress having a first upper surface and a second lower surface and a supporting structure of said bed;

a mounting member attached to said two legs to fix a gap between said two legs at the attached end;

a rail comprising a top frame structure and a lower frame structure movably mounted to said mounting member so as to allow movement of said rail relative to said mounting member; and a coupling assembly, which comprises a rail retainer comprising a hook end for hooking the lower frame structure of the rail, for retaining said rail in a first raised position, said coupling assembly allowing said movement of said rail relative to said mounting member while maintaining said top frame structure above said lower frame structure between said first raised position to a second lowered position; and wherein the lower frame structure is positioned below the first upper surface of the mattress in the second lowered position.

2. The rail assembly of claim 1, wherein said coupling assembly comprises a pair of coupling tubes for slidingly receiving two internal tubing joints mounted to the rail.

3. The rail assembly of claim 1, wherein the mounting member comprises a bar having two ends and an extension at each of the two ends.

4. The rail assembly of claim 1, further comprising a receiving tubing joint mounted to each end of the two legs forming T-joints at the two ends of each leg.

5. The rail assembly of claim 4, wherein each leg comprises a pair of telescoping tubes for adjusting a length of each leg.

6. The rail assembly of claim 1, wherein the rail is removable from the mounting member.

7. The rail assembly of claim 1, wherein the rail retainer is pointable relative to the rail.

8. A rail assembly for a bed, said rail assembly comprising:

a rail guard comprising a perimeter and at least two parallel tubes;

a mounting assembly for mounting the rail guard to a frame support structure, said frame support structure comprising a pair of legs for positioning between a mattress and a mattress supporting structure with each leg comprising a receiving joint at each of its two ends forming a T-joint at each end;

a coupling assembly for coupling the rail guard to the mounting assembly; and wherein the coupling assembly comprises a retaining lock pivotally attached to a bracket; the retaining lock pivoting to rotate a locking end of the retaining lock radially outwardly to move the rail guard to a first position and pivoting to rotate the locking end of the retaining lock radially inwardly to lock the rail guard in a second position.

9. The rail assembly of claim 8, wherein the mounting assembly comprises a mounting tube and an extension leg extending transversely at each end of the mounting tube.

10. The rail assembly of claim 8, further comprising a second mounting assembly and wherein the mounting assembly and the second mounting assembly each comprises a mounting tube and an extension leg extending transversely at each end of the mounting tube, and wherein the four extension legs are each positioned inside a receiving joint.

11. The rail assembly of claim 8, wherein the at least two parallel tubes each comprises a telescoping mechanism.

12. The rail assembly of claim 8, wherein the at least two parallel tubes each comprises a round tube.

13. A rail assembly for a bed, said rail assembly comprising:

a rail guard comprising a perimeter and at least two parallel tubes;

a mounting assembly for mounting the rail guard to a frame support structure, said frame support structure comprising a pair of legs for positioning between a mattress and a mattress supporting structure with each leg comprising a pair of telescoping tubes for adjusting a length of each leg;

a coupling assembly for coupling the rail guard to the mounting assembly; and wherein the coupling assembly comprises a retaining lock pivotally attached to a bracket; the retaining lock pivoting to rotate a locking end of the retaining lock radially outwardly to move the rail guard to a first position and pivoting to rotate the locking end of the retaining lock radially inwardly to lock the rail guard in a second position.

14. The rail assembly of claim 13, further comprising an internal tubing joint mounted transversely to the at least two parallel tubes.

15. The rail assembly of claim 13, wherein the rail guard further comprises at least one tube positioned transversely of the at least two parallel tubes.

16. The rail assembly of claim 13, wherein the retaining lock comprises two hook ends and a cross-bar positioned between the two hook ends.

17. The rail assembly of claim 16, further comprising a second cross-bar.

18. A rail assembly for a bed, said rail assembly comprising:

a rail guard comprising a perimeter and at least two parallel tubes;

a mounting assembly for mounting the rail guard to a frame support structure, said frame support structure comprising a pair of legs for positioning between a mattress and a mattress supporting structure;

a rail retention mechanism having an end for connecting to a bed and an end for connecting to the frame support structure:

a coupling assembly for coupling the rail guard to the mounting assembly; and wherein the coupling assembly comprises a retaining lock pivotally attached to a bracket; the retaining lock pivoting to rotate a locking end of the retaining lock radially outwardly to move the rail guard to a first position and pivoting to rotate the locking end of the retaining lock radially inwardly to lock the rail guard in a second position.

19. The rail assembly of claim 18, wherein the at least two parallel tubes each comprises a telescoping mechanism.

20. The rail assembly of claim 18, wherein the retaining lock comprises two hook ends and a cross-bar positioned between the two hook ends.

* * * * *